United States Patent [19]

Jeffery

[11] Patent Number: 4,631,849

[45] Date of Patent: Dec. 30, 1986

[54] COLLAPSIBLE DISPLAY STANDS

[75] Inventor: Michael R. Jeffery, Hertfordshire, England

[73] Assignee: Storviders Limited, Royston, England

[21] Appl. No.: 715,733

[22] Filed: Mar. 25, 1985

[30] Foreign Application Priority Data

May 31, 1984 [GB] United Kingdom ..... 8413954

[51] Int. Cl.[4] ..... G09F 15/00

[52] U.S. Cl. ..... 40/610; 40/611; 40/606; 160/84 R

[58] Field of Search ..... 40/610, 611, 606; 160/84 H, 84 R, 84 V; D32/58

[56] References Cited

U.S. PATENT DOCUMENTS

| | | | |
|---|---|---|---|
| 1,533,470 | 4/1925 | Schmitt | D32/58 |
| 1,877,950 | 9/1932 | Nordell | 160/84 R |
| 2,155,300 | 4/1939 | Bybee | 40/610 |
| 2,465,724 | 3/1949 | Hembree | 160/84 R |
| 2,746,187 | 5/1956 | Ennever | 40/624 |
| 3,608,221 | 9/1971 | Harris | 40/610 |
| 4,001,987 | 1/1977 | Coulthard | 40/610 |

FOREIGN PATENT DOCUMENTS

| | | | |
|---|---|---|---|
| 8778 | 8/1933 | Australia | 160/84 R |
| 1429694 | 5/1969 | Fed. Rep. of Germany | 160/84 R |
| 81280 | 7/1963 | France | 160/84 R |
| 1389683 | 1/1965 | France | 160/84 R |
| 1430996 | 1/1966 | France | 160/84 R |
| 543937 | 3/1942 | United Kingdom | 160/84 R |

*Primary Examiner*—Robert Peshock
*Assistant Examiner*—J. Hakomaki
*Attorney, Agent, or Firm*—Lee, Smith & Zickert

[57] ABSTRACT

A collapsible display stand which comprises a pair of matching side supports each in the form of a series of articulated struts interconnected by a plurality of horizontal rods defining a zig-zag of inclined planes extending from top to bottom of the erected stand, and display panels disposed in said zig-zag arrangement of planes, each suspended from one rod and resting in the corresponding inclined plane against the rod below it.

10 Claims, 12 Drawing Figures

COLLAPSIBLE DISPLAY STANDS

FIELD OF THE INVENTION

This invention relates to a collapsible display stand.

OBJECT OF THE INVENTION

The object of the invention is to provide a collapsible but easily erectable stand which is capable of displaying exchangeable members such as display panels in an unusual and attractive manner

THE INVENTION

The collapsible display stand according to the invention comprises a pair of matching side supports each in the form of a series of articulated struts extensible from a compact collapsed condition to an elongated criss-cross array, a plurality of rods mounted between corresponding points of corresponding struts of the side supports in a disposition such that all the rods are not in vertical alignment in the extended condition of the side supports, display members suspended from at least some of the rods, said display members lying in a flat stack in the collapsed condition of the side supports and each being elevated into an inclined position in which it rests against a rod below the one from which it is suspended in the extended condition of said side supports, and means for locking the stand with the side supports in the extended condition.

A preferred arrangement is one in which the rods, in the erected condition of the stand, lie in two vertical planes, with one rod in each of a series of equally spaced horizontal planes wherein the rods alternate between one vertical plane and the other (although at the bottom of the stand two rods in a single horizontal plane will preferably be provided in order to define a stable support). The display panels or the like can then form a zig-zag arrangement from top to bottom of the stand, alternate panels resting respectively against one side and the other side of the rod below the one from which a panel is suspended. Display material may be carried by either one or both faces of a display panel.

It is possible for the display members to be pivotally suspended from the rods. Alternatively (or possibly additionally), however, the rods may be rotatably connected to the struts. Each suspension between the display members and the rods may include a detachable connection, enabling display members to be interchanged or exchanged; such a detachable connection may comprise a resilient clip, for example a PVC extruded clip section, having two curved arms which resiliently grip the rod between them.

The points at which the rods are connected to the struts may also coincide with some of the points at which the struts are articulated, and a common connecting pivotal connection means may be employed at these points, both to provide the articulation of the struts and to provide a rotatable mounting for the rods.

A preferred pivotal connection means at all points of articulation is a screwthread connection. The use of right-hand and left-hand threads at the respective side supports enables an automatic tightening together of the connected parts to be achieved when the stand is erected, thereby to assist locking in the erected condition, and also to assist in rigidifying the erected stand. This facilitates use of a single, simple locking device in the form of a releasable stay, pivotted on one rod and releasably cooperating with another, preferably the two bottom rods which lie in a common horizontal plane.

A preferred form of articulation between two struts is constituted by an internally threaded sleeve pushfitted into a recess in one strut and an externally threaded stud fixed to the other strut. When the point of articulation corresponds to the point of fixing of a rod, the sleeve is preferably press-fitted into a recess in the end face of the rod, and a longer stud is employed, fixed on one strut and passing through an aperture in the other into screwthreaded engagement with the rod sleeve. As previously mentioned, at opposite ends of each rod, the employment of right-hand and left-hand threads, respectively, can enable an automatic tightening together of the connected parts when the stand is erected, thus adding rigidity.

A preferred construction of stand utilises aluminium bars for the struts, hollow aluminium rods. Each rod carries a display panel of plastics material; the latter is attached to the rod by means of plastics clips each having a pair of legs gripping the panel between them (at least one leg having a projection locking into a matching recess in the panel face) and having the pair of somewhat resilient curved arms previously mentioned, which releasably cooperate with the rod and enable the panel to swing relatively to the rod. The height of each display panel is such that, in the erected condition of the stand, it is unable to swing into a vertical position, but instead comes to rest in an inclined position with its lower edge region lying against one side of the rod below the one from which it is suspended. Alternate display panels (from top to bottom) respectively have opposite equal inclinations to the vertical; the order of the angle of inclination may be in the range 10 to 25degrees. locking stay in the preferred construction is also of plastics material, taking the general form of a board with a clip along one edge for non-rotatably fixing to one bottom rod and a hook along the opposite edge for releasable engagment with the other bottom rod. Collapse of the stand thus involves the initial step of disengaging the said other bottom rod from the fixed stay, whereby the display panels are able to stack on top of one another against the bottom board as the struts of the side supports concertina together.

BRIEF DESCRIPTION OF DRAWINGS

A practical arrangement of collapsible display stand in accordance with the invention is shown in the accompanying drawings, in which.

DESCRIPTION OF EMBODIMENT

Figure 1:
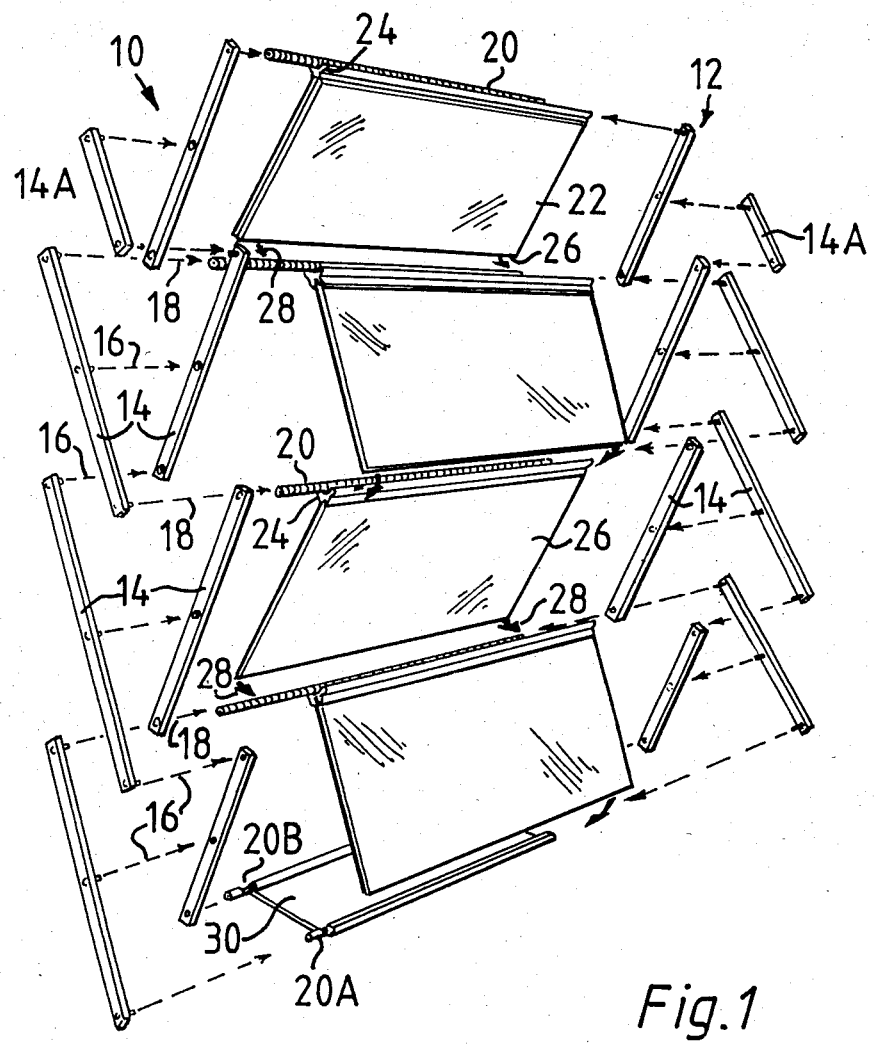
FIG. 1 is a view of the erected stand with the parts disassembled.

Referring first to FIG. 1, the collapsible display stand comprises opposed side supports 10, 12 each made up of a similar series of struts, generally referenced 14. The struts 14, made of aluminium bar, are of similar lengths with the exception of the strut 14A at the top.

The struts are articulated together at the points 16, 18. At the point 18, the means of articulation is also employed to secure cross rods 20 in position. Rods 20 are of hollow aluminium rod and extend between corresponding points of corresponding struts of the opposed side supports 10, 12.

Display panels 22 of plastics material (3 mm thickness) are releasably suspended from the rods by means of clips 24. In the erected condition of the stand, the display panels swing to lie each with its lower edge region 26 against one side of the rod below the one from which it is suspended, as indicated by arrow 28. In FIG. 1, the axes of articulation, 16, 18, are also indicated by arrows.

In the erected condition, a locking stay 30 holds the stand in position against collapse. This stay 30 extends between two bottom rods 20A, 20B, neither of which carries a display panel, although one is used as a rest for the display panel suspended from the rod above it.

Studying the disassembled erected stand as shown in FIG. 1, it will be noted that the rods 20 lie in two spaced vertical planes, with one rod in each of a succession of horizontal planes alternating from one vertical plane to the other. The display panels take a zig-zag formation from top to bottom, alternately with opposite inclinations of about 20 degrees to the vertical.

Figure 2:
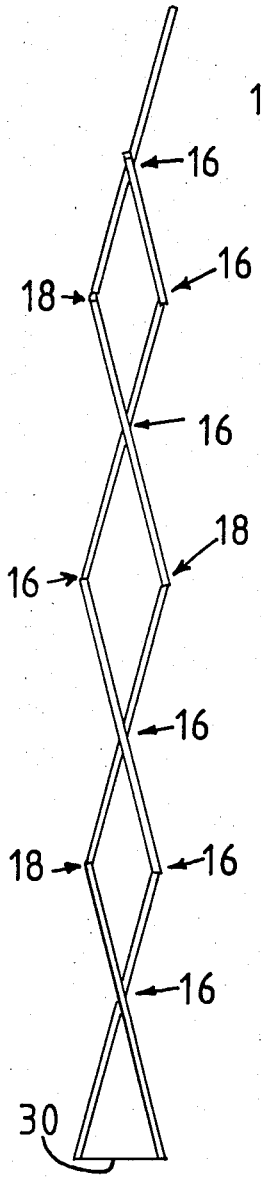
FIG. 2 is a side view of the erected stand, with display panels detached.
Figure 3:
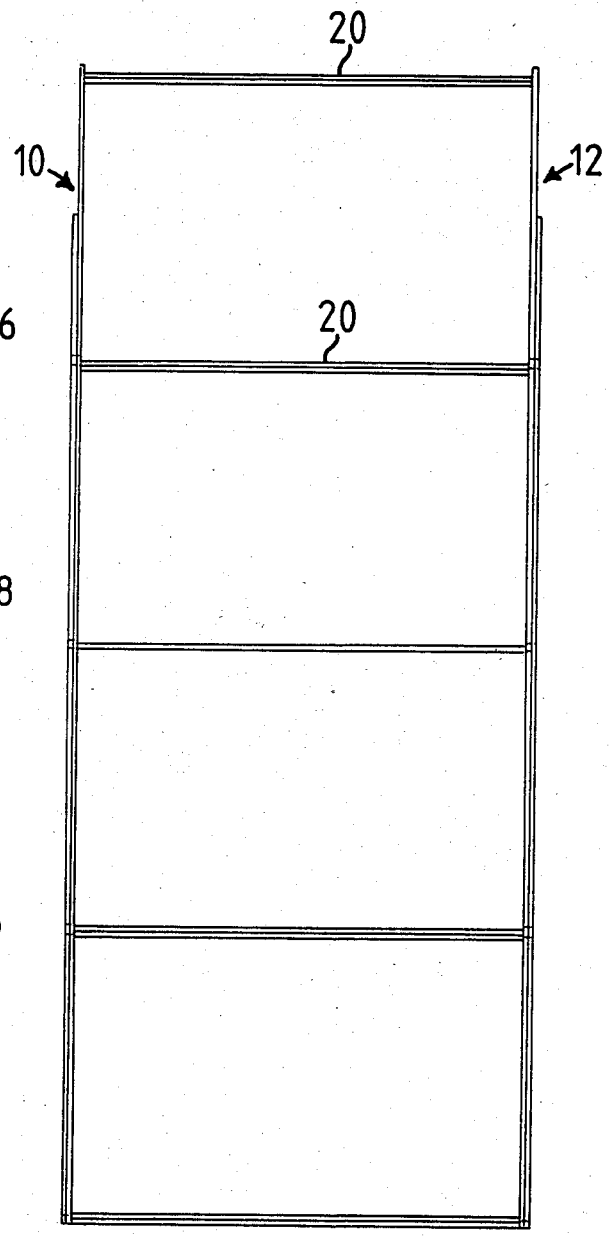
FIG. 3 is a front view corresponding to FIG. 2.

FIGS. 2 and 3 show the fully assembled stand, in erected condition, respectively from the side and from the front, the display panels having been detached. The references 16, 18 in FIG. 2 respectively denote the articulations where only two struts 14 are connected and the articulations where a rod 20 is connected, in addition to the two struts.

Figure 4A:
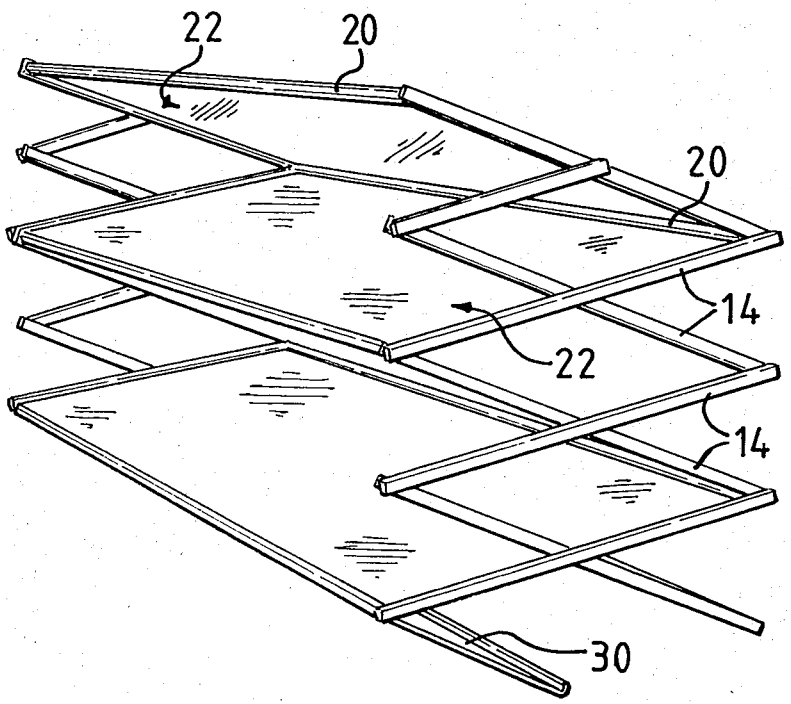
FIGS. 4 and 4A are views showing the partially collapsed stand.
Figure 4:
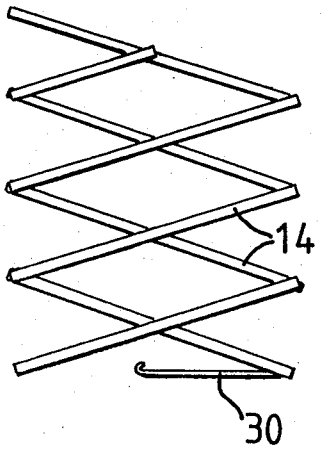

FIG. 4 and 4A show the stand in a partially collapsed condition, the display panels 22 also being included in FIG. 4A. The rod 20B is disengaged from the stay 30, allowing both the side supports 10, 12 to collapse as the struts concertina together and the panels to descend into a stack between the collapsed side supports.

Figure 5:
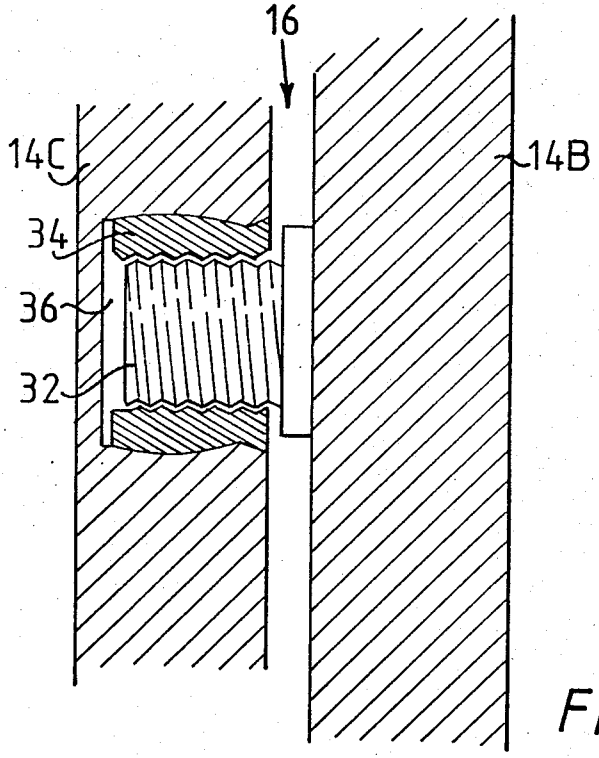
FIG. 5 shows the articulation between two struts.

FIGS. 5 to 8 show details of the other parts of the stand. Firstly, FIG. 5 illustrates the connecting means forming the articulation 16 between two struts. An externally threaded stud 32 is bonded on to one strut 14B, and an internally threaded sleeve 34 is press-fitted into a recess 36 in the other strut 14C. The recess 36 is slightly bulbously formed so as permanently to hold the sleeve 34 once the latter has been pushed into place.

Figure 6:
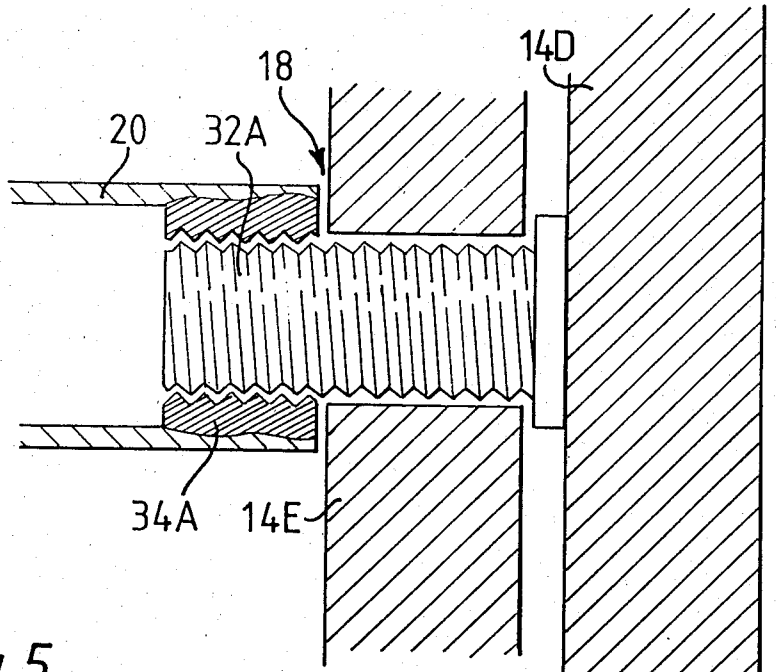
FIG. 6 shows the articulation between two struts and a rod.

Secondly, FIG. 6 illustrates the connecting means forming the articulation 18 where a rod 20 is also connected. This is analogous to the connecting means of FIG. 5, but a longer threaded stud 32A is employed, bonded to one strut 14D and extending through an aperture 38 in the other strut 14E to engage into an internally threaded sleeve 34A permanently press-fitted into a recess in the end face of the rod 20.

By using right-hand and left-hand threads at opposite sides of the stand, it is arranged that the parts 14 and 20 are tightened together when the stand is erected. This assists in locking the stand in the erected condition and also assists in maintaining the rigidity of the erected stand. When the stand is collapsed, the cooperating screwthreads automatically untighten the parts.

Figure 7:
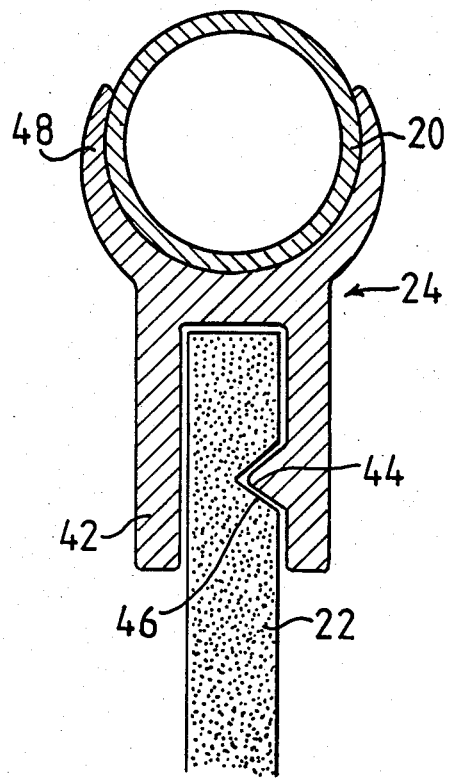
FIG. 7 shows a suspension clip for a display panel.

FIG. 7 shows a suspension clip 24 by which a display panel 22 is mounted to a rod 20. The clip, moulded of plastics material, has two legs 42 one with an inward pointed projection 44. The legs grip the top edge region of the panel 22, with the projection located in a matching recess, 46 in one face of said panel. The clip 24 also has two curved arms 48 which resiliently snap fit around the rod 20 in a detachable manner, at the same time allowing the panel to swing relatively to the rod about the axis of the latter.

Figure 8:
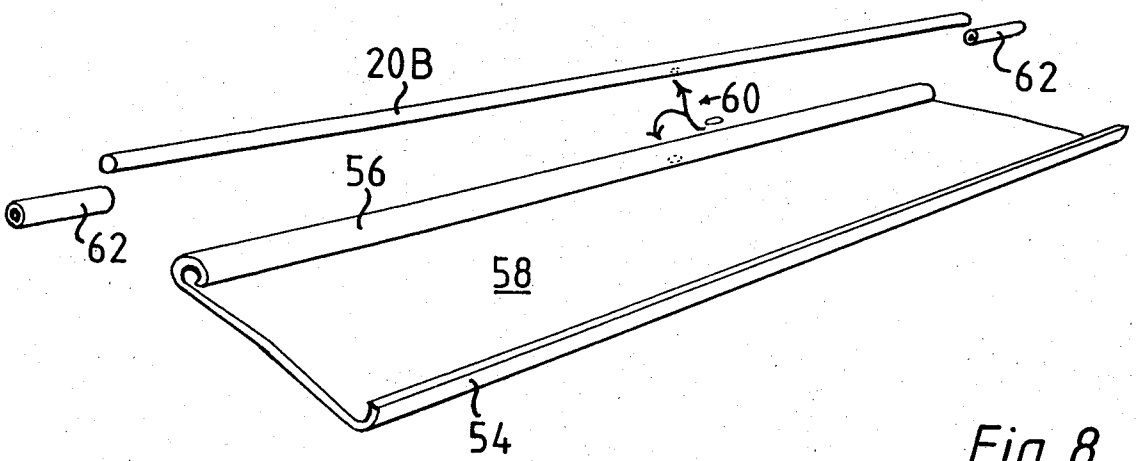
FIG. 8 is a disassembled view of a locking stay.

Finally, FIG. 8 shows the stay 30, for locking between the two bottom rods 20A, 20B. It can be seen that the rod 20B may be of smaller diameter than the other rods 20, and is received through a circular hollow lip 56 moulded integrally with and along one edge of a plastics board or panel 58 which constitutes the stay 30. Reference 60 denotes means, such as holes receiving a locking pin, whereby the panel 58 is fixed against rotation about the rod 20B. At its ends the rod 20B is equipped with internally threaded, larger diameter sleeves 62 enabling attachment in the previously described manner to the appropriate strut 14. At the opposite edge to the lip 56, the stay panel 58 is moulded with a hookshaped edge 54 for engagement with the rod 20A. The initial step in collapsing the stand is to disengage the rod 20A from the stay 30.

Figure 10:
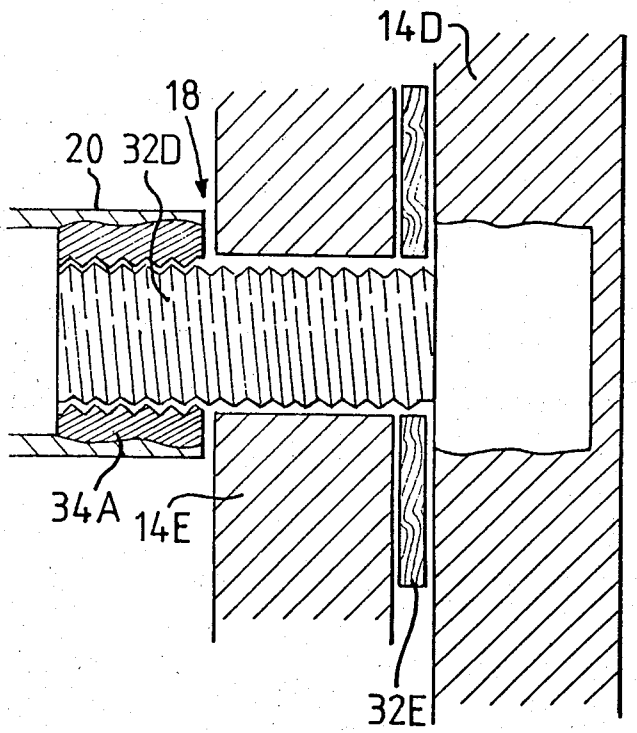
FIGS. 9 and 10 show modifications to the articulating means of FIGS. 5 and 6.
Figure 9:
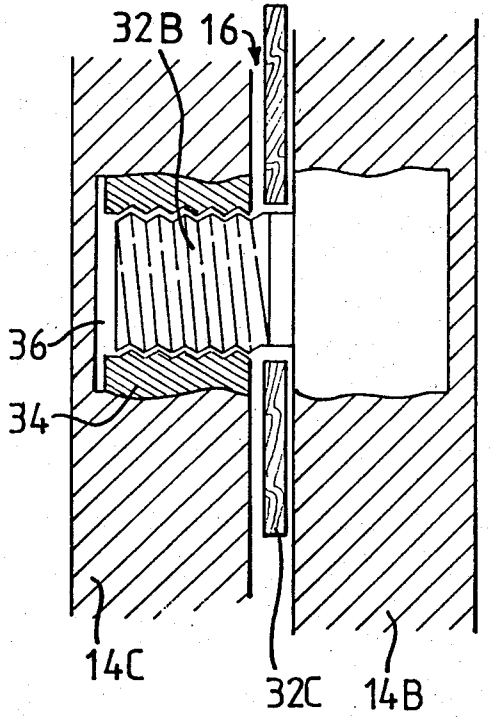

FIGS. 9 and 10 show modifications to the details previously described with reference to FIGS. 5 and 6.

In FIG. 9, the connecting means of FIG. 5 is modified by use of an externally threaded stud 32B which is press-fitted into a recess in the strut 14B, an annular spacer 32C being provided between said strut 14B and the strut 14C.

In FIG. 10, the connecting means of FIG. 6 is similarly modified by use of a threaded stud 32D press fitted into a recess in the strut 14D, an annular spacer 32E being provided between said strut 14D and the strut 14E.

The nature of these press-fitting studs 32B and 32D is analogous to that hitherto described with reference to the sleeves 34 and 34A in FIGS. 5 and 6.

Figure 11:
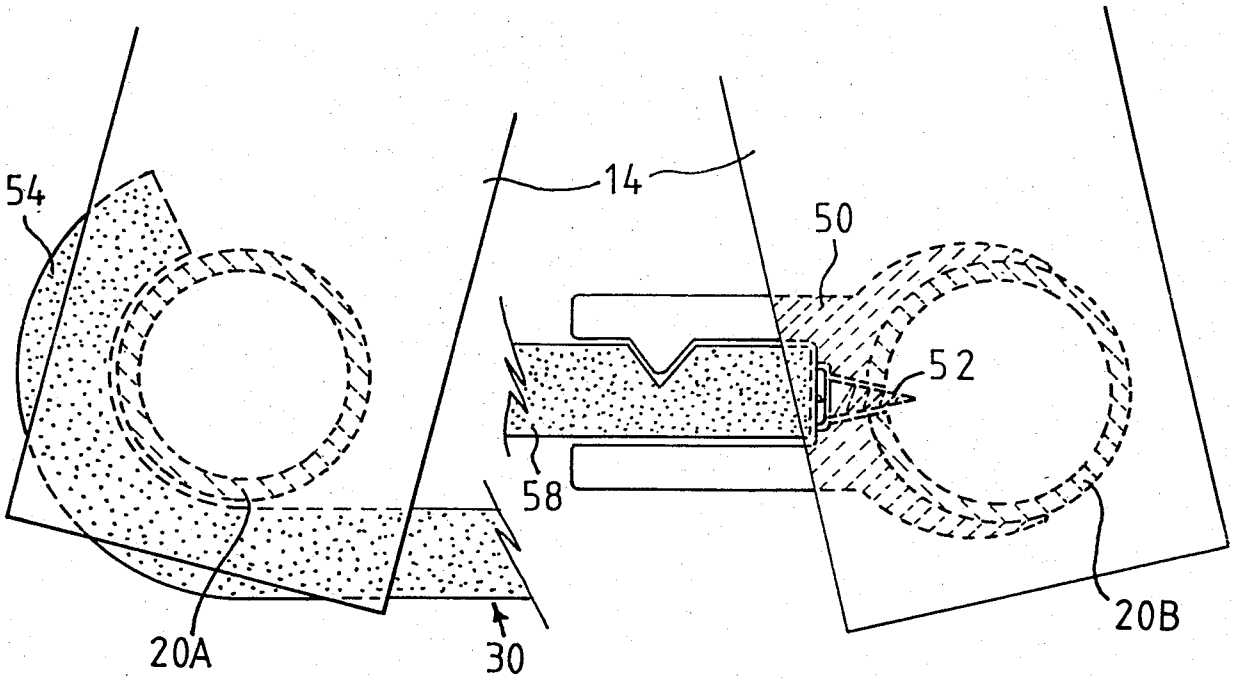
FIG. 11 is a view, broken in the centre, of a modified locking stay.

FIG. 11 shows a modified stay 30, for locking between the two bottom rods 20A, 20B. In this modification, the stay 30 takes the form of a plastics board or panel 58 fitted along one edge with a plastics clip 50 similar in cross-sectional shape to the clip 24 (see FIG. 7) but elongated to extend the full length of the rod 20B to which it is fitted. The fixing is again non-rotational, and to prevent the stay pivotting relative to the rod 20B one or more tangs 52 are incorporated in the clip 50, which penetrate the cylindrical wall of the rod 20B when the clip is press-fitted into position. At the opposite edge to the clip 50, the stay panel is as before moulded with a hook shaped edge 54 for engagement by the rod 20A, and the initial step in collapsing the stand is to disengage the rod 20A from the fixed stay.

A typical stand may be 80 cm wide and 2 meters high when erected, having four display panels as illustrated. However, other arrangements are possible, including arrangements in which a side support of articulated struts carries rods contributing to the support of display panels on both sides, i.e. an arrangement of two or more display stands side by side utilising common intermediate side supports. Further, the display panels may be replaced by other members, e.g. frames which can hold display material, which are rigid and will rest against the rods in an inclined position when the stand is erected. Other modifications of the described arrangement are also possible within the scope of the invention hereinbefore defined.

I claim:

1. A collapsible display stand comprising:

a pair of matching side supports, each side support comprising a series of articualated struts extensible from a compact collapsed condition to an upstanding criss-cross array, a plurality of rods mounted between corresponding points of corresponding struts of the respective side supports, said rods being so disposed that some said rods lie in each of at least two vertical planes in the extended condition of the side supports, display members suspended from at least some of the rods, each display member being pivotally connected at one edge thereof to one said support rod and being unconnected at its other edges to allow free rotation of said member about the support rod from which it is suspended, said display members being adapted to lie in a flat stack in the collapsed condition of the side supports and each to be elevated into an inclined position in which it rests against a rod below the one from which it is suspended in the extended condition of the side supports, and means for locking the stand with the side supports in the extended condition, said locking means including devices operative automatically to rigidify the side supports when the stand is extended to an erected position.

2. A display stand according to claim 1 having a base support above which the rods, in the erected condition of the stand, lie in two vertical planes, with one rod in each of a series of equally spaced horizontal planes wherein the rods alternate between one vertical plane and the other.

3. A display stand according to claim 2 wherein, in the erected condition of the stand, the display members form a zig-zag arrangement from top to bottom of the stand, alternate panels resting respectively against one side and the other side of the rod below the one from which a panel is suspended.

4. A display stand according to claim 3, wherein the base support is constituted by two rods lying in a common horizontal plane, said two base rods being interconnectable by said locking means.

5. A display stand according to claim 1, wherein each display member is pivotally suspended from the corresponding rod by means including a detachable connection.

6. A display stand according to claim 1, wherein the points at which the rods are connected to the struts coincide with some of the points at which the struts are articulated to one another, and a common connecting pivotal connection means may be employed at these points, both to provide the articulation of the struts and to provide a rotatable mounting for the rods.

7. A display stand according to claim 1, wherein the connection at each point of articulation is a screwthread connection.

8. A display stand according to claim 7, wherein right-hand and left-hand screwthread connections are provided at the respective side supports.

9. A collapsible display stand comprising:

a pair of matching side supports, each side support comprising a series of articulated struts extensible from a compact collapsed condition to an upstanding criss-cross array, a plurality of rods mounted between corresponding points of corresponding struts of the respective side supports, said rods being so disposed that some said rods lie in each of at least two vertical planes in the extended condition of the side supports, display members suspended from at least some of the rods, each display member being pivotally connected at one edge thereof to one said support rod and being unconnected at its other edges to allow free rotation of said member about the support rod from which it is suspended, said display members being adapted to lie in a flat stack in the collapsed condition of the side supports and each to be elevated into an inclined position in which it rests against a rod below the one from which it is suspended in the extended condition of the side supports;

wherein the means of articulation between the struts comprises screwthread connections which at one side support have oppositely handed screwthreads to those at the other side support, whereby the interconnected parts tend to tighten automatically into a locked condition when the stand is erected.

10. A collapsible display stand according to claim 9, wherein the rods are also connected to the struts at some of said points at which the struts are articulated by self-tightening screwthread connections.

* * * * *